US011406552B2

(12) United States Patent
Viljoen

(10) Patent No.: US 11,406,552 B2
(45) Date of Patent: Aug. 9, 2022

(54) ENLINER INFLATABLE INTUBATION PILLOW

(71) Applicant: Gerhard Viljoen, Jacksonville, OR (US)

(72) Inventor: Gerhard Viljoen, Jacksonville, OR (US)

( * ) Notice: Subject to any disclaimer, the term of this patent is extended or adjusted under 35 U.S.C. 154(b) by 500 days.

(21) Appl. No.: 16/506,464

(22) Filed: Jul. 9, 2019

(65) Prior Publication Data

US 2020/0008999 A1 Jan. 9, 2020

Related U.S. Application Data

(63) Continuation-in-part of application No. 29/690,032, filed on May 3, 2019, now Pat. No. Des. 898,460.

(60) Provisional application No. 62/695,466, filed on Jul. 9, 2018.

(51) Int. Cl.
*A61G 13/12* (2006.01)

(52) U.S. Cl.
CPC ..... *A61G 13/1215* (2013.01); *A61G 13/1265* (2013.01)

(58) Field of Classification Search
CPC .. A61G 13/126; A61G 13/1265; A61G 7/072; A47G 9/10; A47G 2009/003; A47G 9/0253; A47G 9/1045; A47G 9/1009; A47C 7/383; A61F 11/14
USPC ..... 5/622, 636, 637, 638; 602/18–19, 13
See application file for complete search history.

(56) References Cited

U.S. PATENT DOCUMENTS

| | | | | |
|---|---|---|---|---|
| 4,893,367 | A | 1/1990 | Heimreid | |
| 5,184,365 | A | 2/1993 | Stafford | |
| 6,327,724 | B1 | 12/2001 | Sharrock et al. | |
| 6,935,340 | B2 | 8/2005 | Saied | |
| 7,210,176 | B2 | 5/2007 | Weedling | |
| 7,337,777 | B1 | 3/2008 | Islava | |
| 2004/0010853 | A1* | 1/2004 | Muci ..... | A47C 27/081 5/644 |

* cited by examiner

*Primary Examiner* — Ophelia A Hawthorne

(57) ABSTRACT

An inflatable pillow is invented to provide an effective and efficient method to improve the oral intubation procedure in the pre-hospital setting, both in the ground and air ambulances along with emergency rooms in hospitals to eliminate intubation failures. The inflatable pillow comprises a bladder body and an air valve. The air valve is distally positioned on the body so that the air valve is not in the way when a user is positioning a patient's head on the pillow. Thus, the inflatable pillow can be positioned or moved more towards the patient's neck and shoulder area for a better head position or view of the vocal cords. Additionally, the inflatable pillow can be used to adjust the height of the patient's head by inflating and/or deflating the pillow through the air valve prior to and/or during the first pass intubation procedure, thus, making the intubation procedure more reliable.

6 Claims, 3 Drawing Sheets

ENLINER INFLATABLE INTUBATION PILLOW

The current application claims a priority to the U.S. Provisional Patent application Ser. No. 62/695,466 filed on Jul. 9, 2018.

FIELD OF THE INVENTION

The present invention relates generally to an apparatus for a pillow. More specifically, the present invention is an apparatus for a pillow that elevates the head of a patient into the sniffing position prior to the oral intubation procedure.

BACKGROUND OF THE INVENTION

Airway management is viewed by most Emergency Medical Services (EMS) systems as the highest prehospital patient priority. In the constantly changing field of prehospital care, there exist many EMS systems that have approached intubation in the field very differently. Although individual system success rates may seem high, there is always an adverse outcome with any missed airway. According to Journal of Emergency Medical Services (JEMS), field paramedics have an intubation fail rate of 25% on adults and almost 50% on pediatrics. As medical procedures and equipment advance, EMS professionals are being taught the new ways of performing procedures when attending airway educational seminars, conferences, and workshops. Improvements in technique and placement of patients during endotracheal intubation have shown that lifting the head of a patient into the sniffing position is the best placement for successful first pass intubation. This technique has been used by anesthesiologists in the operating room setting for a long time but has not made it to the pre-hospital environment nor has it been taught in airway education in the past. Education on patient placement for EMS professionals has only come about in recent years. Lifting the patient's head into the sniffing position, whereby, aligning the three axes in the throat of the patient allows for the best possible view of the vocal cords. By having the auditory canal or Tragus in line with the sternal notch of the chest, a provider (paramedic or doctor) can be sure that the internal axes are lined up and the provider can expect to have the best possible view of the vocal cords; which will give the provider the best chance of a successful first pass intubation. In the field of prehospital care, such as ground and/or air ambulances, however, there is no apparatus or device used for lifting the patient's head into the sniffing position. In hospital operating rooms, anesthesiologists use a device to list a patient's head for the intubation procedure. The devices used are fixed and non-adjustable, and mostly consists of materials which are fixed and unshapable. Due to this restriction, such a device does present ineffectiveness if the height of the patient's head needs to be adjusted before and/or during the intubation procedure.

It is an objective of the present invention to provide a solution to the aforementioned problems, drawbacks, and issues for the oral intubation procedure in the pre-hospital setting, both in the ground and air ambulances along with most emergency rooms in hospitals. The present invention is an inflatable bladder and/or pillow that can be used to elevate the head of a patient into the sniffing position prior to the oral intubation procedure. Additionally, the inflatable pillow can be positioned or manipulated beneath the patient's neck and shoulder area if required for a better or different position to view the vocal cords. Further, the inflatable pillow of the present invention can be used to adjust the height of the patient's head by inflating and/or deflating the pillow prior to and/or during the intubation procedure, thus, making the intubation procedure more effective and efficient, and minimizing or eliminating intubation failures.

SUMMARY OF THE INVENTION

An inflatable intubation pillow is intended to provide a solution to the problems and drawbacks related to the current oral intubation procedure in the pre-hospital setting, both in the ground and air ambulances along with emergency rooms in hospitals. The inflatable intubation pillow of the present invention offers an effective and efficient method to minimize or eliminate intubation failures in these situations. The inflatable intubation pillow comprises a body and an air valve. The body can be a bladder type of body that provides comfortable cushion to a patient's head and can be inflated and/or deflated. Additionally, the body can be made of any suitable air-tight material and can be of any shape per the user's desire. The air valve may include a pump adaptor and a sealing plug/cover. Additionally, the air valve can comprise a dual-purpose adaptor that is a pump adaptor and a sealing plug. Further, the air valve is distally positioned on the body so that the air valve is not in the way when a user is positioning the patient's head on the pillow. Thus, the inflatable intubation pillow can be positioned or moved more towards the patient's neck and shoulder area for a better head position or view of the vocal cords. Additionally, the inflatable intubation pillow can be used to adjust the height of the patient's head by inflating and/or deflating the pillow through the air valve prior to and/or during the intubation procedure, thus, making the intubation procedure more reliable.

DETAIL DESCRIPTIONS OF THE INVENTION

All illustrations of the drawings are for the purpose of describing selected versions of the present invention and are not intended to limit the scope of the present invention.

The present invention comprises an inflatable intubation pillow and/or bladder intended for EMS/pre-hospital use for an oral intubation procedure in the pre-hospital setting, both in the ground and air ambulances along with most emergency rooms in hospitals. The present invention can be used to elevate the head of a patient into the sniffing position prior to the oral intubation procedure. Additionally, the inflatable intubation pillow can be positioned or moved more towards the patient's neck and shoulder area if necessary, for a better head position or view of the vocal cords. Further, the inflatable pillow of the present invention can be used to adjust the height of the patient's head by inflating and/or deflating the pillow prior to and/or during the first pass intubation procedure. By elevating the head, the axes of the posterior oropharynx (pharyngeal opening, oral and tracheal axis) are aligned whereby improving first pass intubate success. This creates the optimal head positioning for intubation, thus, making the intubation procedure more effective and efficient, and minimizing or eliminating intubation failures.

Figure 1:
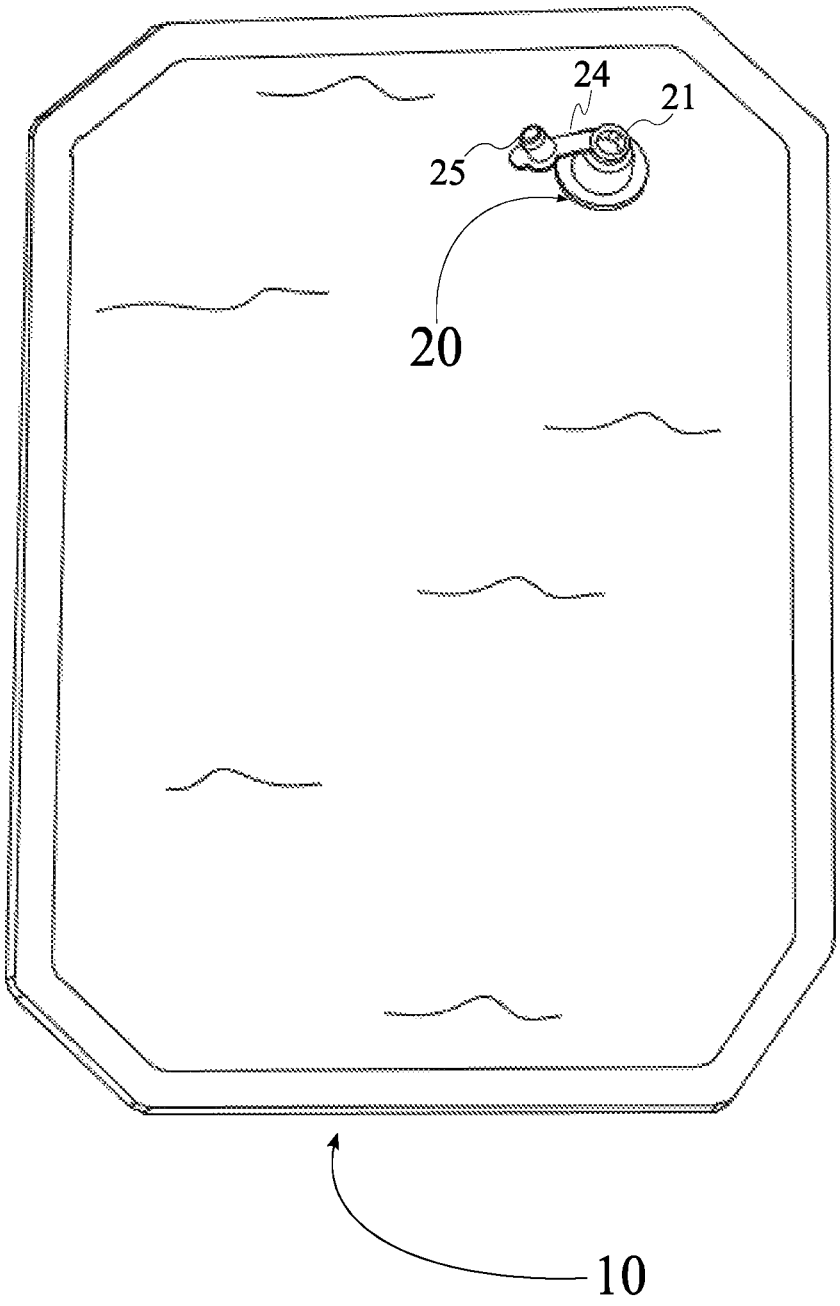
FIG. 1 is a front view of the present invention.
Figure 2:
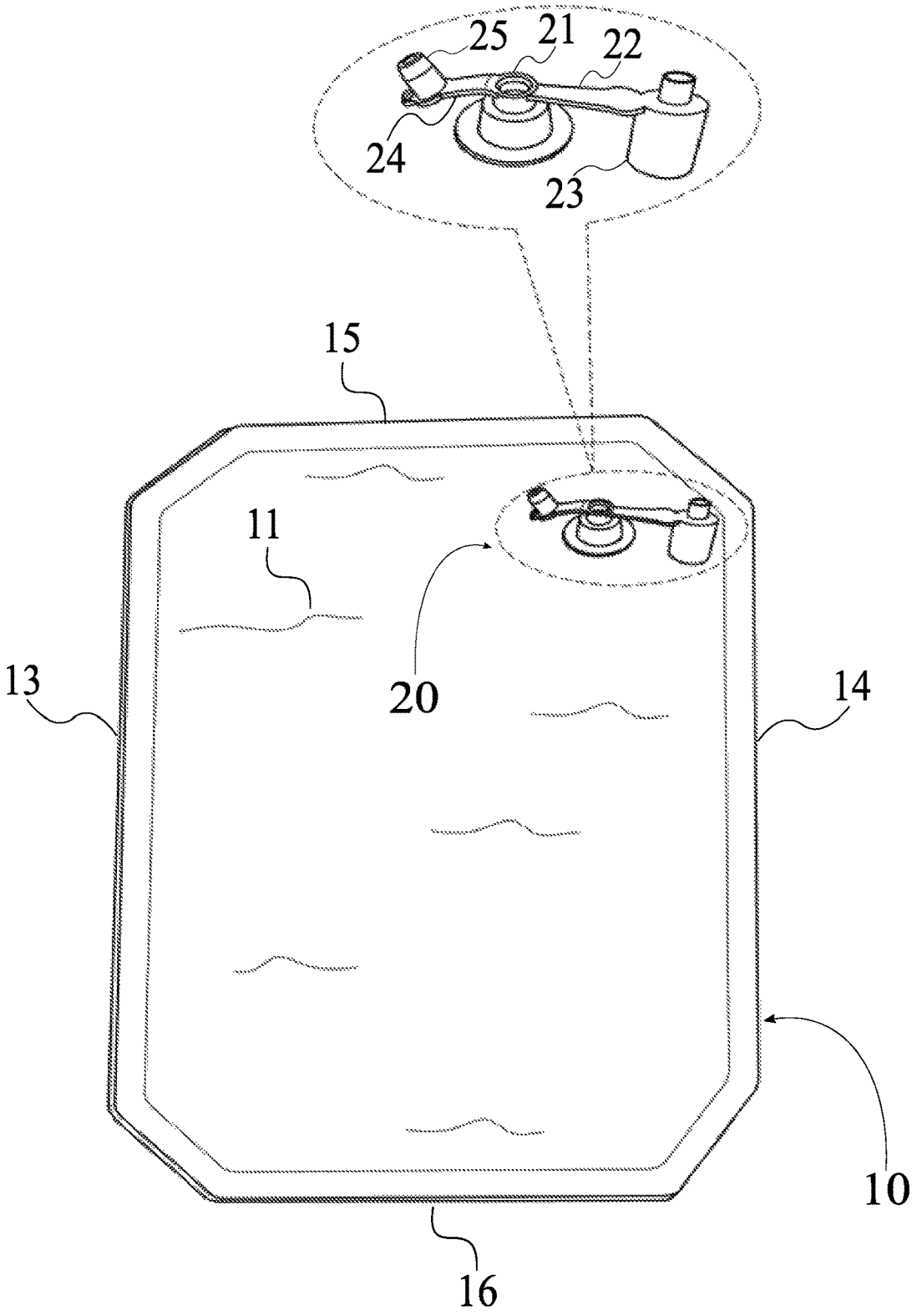
FIG. 2 is a front view with a scaled-up illustration of the air valve of the present invention.
Figure 3:
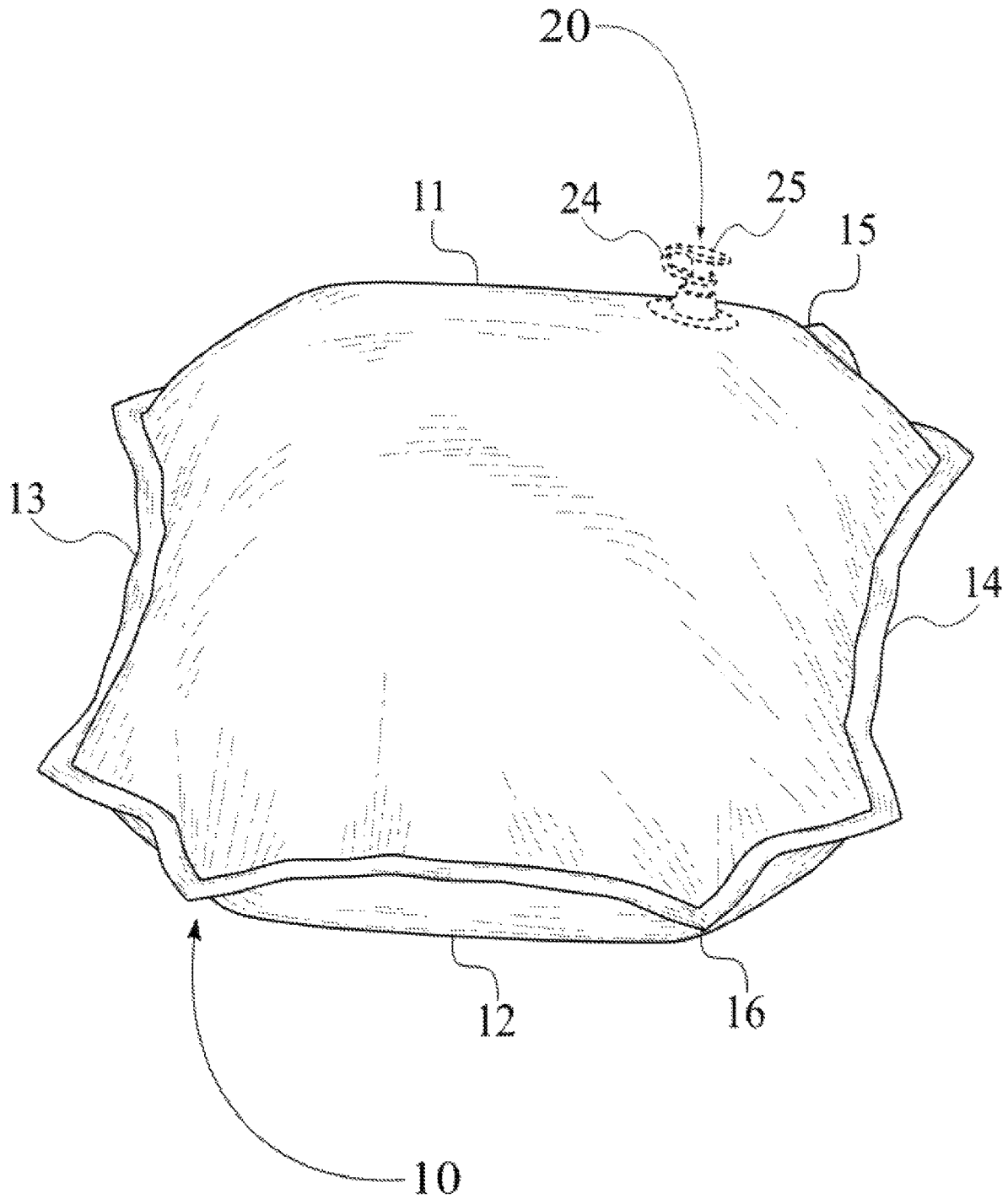
FIG. 3 is a perspective view of an inflated embodiment of the present invention.

As can be seen in FIG. 1 to FIG. 3, the inflatable intubation pillow of the present invention comprises a body 10 and an air valve 20. More specifically, the body 10 can be deflated, as seen in FIG. 1 and FIG. 2, or inflated, as seen in FIG. 3, through the air valve 20 to any desired height by a user prior to and/or during an oral intubation procedure for a patient. The body 10 can be, but is not limited to, an air-tight bladder and can be made of plastic material including, but not limited to, transparent/translucent polyethylene, plastic, rubber, nylon, fabric, any other suitable material, or any combination of the materials thereof. Additionally, the body 10 can be of a shape including, but not limited to, square, rectangular, circular, oval, diamond, dome, or any other suitable shape. In the preferred embodiment of the present invention, the body 10 comprises a font 11 and the air valve 20 is terminally and distally positioned on the front 11. Further, in an alternative embodiment of the present invention, the body 10 comprises a back 12, a first side 13, a second side 14, a top 15, and a bottom 16, as seen in FIG. 2 and FIG. 3. The back 12 is positioned opposite the front 11. The first side 13 and the second side 14 are terminally and longitudinally positioned on the body 10, opposite each other. The top 15 and the bottom 16 are terminally and laterally positioned on the body 10, opposite each other. The air valve 20 is positioned on the front 10 adjacent the top 15 and the second side 15 of the body 10. The distal location of the air valve 20 on the body 10 is critical so that the air valve 20 provides the user convenient and effective operation to adjust the height of the inflatable intubation pillow of the present invention prior to and/or during the first pass oral intubation procedure while does not get in the way of setting the patient's head comfortably on the pillow.

As can be seen in FIG. 2, in the preferred embodiment of the present invention, the air valve 20 comprises an opening 21, a cover connector 22, a valve cover 23, an adaptor connector 24, and a pump adaptor 25. The opening 21 is terminally positioned on the air valve 20 opposite the front 11 of the body 10. The cover connector 22 is terminally and peripherally connected to the air valve 20 adjacent the opening 21. The valve cover 23 is terminally positioned on the cover connector 22 opposite the opening 21 of the air valve 20. The adaptor connector 24 is terminally and peripherally connected to the air valve 20 adjacent the opening 21. Additionally, the adaptor connector 24 is positioned on the air valve 20 opposite the cover connector 22, and the pump adaptor 25 is terminally positioned on the adaptor connector 24 opposite the opening 21 of the air valve 20. Additionally, the air valve 20 may include other embodiments, one of which can be a dual-purpose adaptor for an air pump and a plug cover, as seen in FIG. 1 and FIG. 3. In this exemplary embodiment, the pump adaptor 25 includes, but is not limited to, an adaptor that can be used as an air pump adaptor to inflate and/or deflate the present invention, and a valve cover or plug to seal the opening 21 when inflation and/or deflation is complete. Further, the air valve 20 can be made of materials including, but not limited to, the same material of the body 10, any suitable rubber, plastic, nylon, etc.

Although the invention has been explained in relation to its preferred embodiment, it is to be understood that many other possible modifications and variations can be made without departing from the spirit and scope of the invention as hereinafter claimed.

What is claimed is:

1. An inflatable pillow for fitting under a patient's head to create an alignment for sniffing position prior to and during an intubation procedure comprising:

a body;

an air valve;

the body being an air-tight bladder;

the body comprising a front;

the air valve being terminally and distally positioned on the front of the body;

the air valve comprising an opening, a cover connector, a valve cover, an adaptor connector, and a pump adaptor;

the opening being terminally positioned on the air valve opposite the front of the body;

the cover connector being terminally and peripherally connected to the air valve adjacent the opening;

the valve cover being terminally positioned on the cover connector opposite the opening of the air valve;

the adaptor connector being terminally and peripherally connected to the air valve adjacent the opening;

the adaptor connector being positioned on the air valve opposite the cover connector; and the pump adaptor being terminally positioned on the adaptor connector opposite the opening of the air valve.

2. The inflatable pillow for fitting under a patient's head to create an alignment for sniffing position prior to and during an intubation procedure as claimed in claim 1 comprising:

the body comprising a back, a first side, a second side, a top and a bottom;

the back being positioned opposite the front;

the first side and the second side being terminally and longitudinally positioned on the body opposite each other;

the top and the bottom being terminally and laterally positioned on the body opposite each other; and the air valve being positioned on the front adjacent the top and the second side of the body.

3. The inflatable pillow for fitting under a patient's head to create an alignment for sniffing position prior to and during an intubation procedure as claimed in claim 1, wherein the pump adaptor is an air pump adaptor and a plug/cover to seal the opening of the air valve.

4. An inflatable pillow for fitting under a patient's head to create an alignment for sniffing position prior to and during an intubation procedure comprising:

a body;

an air valve;

the body being an air-tight bladder;

the body comprising a front, a back, a first side, a second side, a top and a bottom;

the back being positioned opposite the front;

the first side and the second side being terminally and longitudinally positioned on the body opposite each other;

the top and the bottom being terminally and laterally positioned on the body opposite each other; and the air valve being positioned on the front adjacent the top and the second side of the body;

the air valve comprising an opening, a cover connector, a valve cover, an adaptor connector, and a pump adaptor;

the opening being terminally positioned on the air valve opposite the front of the body;

the cover connector being terminally and peripherally connected to the air valve adjacent the opening;

the valve cover being terminally positioned on the cover connector opposite the opening of the air valve;

the adaptor connector being terminally and peripherally connected to the air valve adjacent the opening;

the adaptor connector being positioned on the air valve opposite the cover connector; and the pump adaptor being terminally positioned on the adaptor connector opposite the opening of the air valve.

5. The inflatable pillow for fitting under a patient's head to create an alignment for sniffing position prior to and during an intubation procedure as claimed in claim 4, wherein the pump adaptor is an air pump adaptor and a plug/cover to seal the opening of the air valve.

6. An inflatable pillow for fitting under a patient's head to create an alignment for sniffing position prior to and during an intubation procedure comprising:

a body;

an air valve;

the body being an air-tight bladder;

the body comprising a front, a back, a first side, a second side, a top and a bottom;

the back being positioned opposite the front;

the first side and the second side being terminally and longitudinally positioned on the body opposite each other;

the top and the bottom being terminally and laterally positioned on the body opposite each other; and the air valve being positioned on the front adjacent the top and the second side of the body;

the air valve comprising an opening, a cover connector, a valve cover, an adaptor connector, and a pump adaptor;

the opening being terminally positioned on the air valve opposite the front of the body;

the cover connector being terminally and peripherally connected to the air valve adjacent the opening;

the valve cover being terminally positioned on the cover connector opposite the opening of the air valve;

the adaptor connector being terminally and peripherally connected to the air valve adjacent the opening;

the adaptor connector being positioned on the air valve opposite the cover connector; and the pump adaptor being terminally positioned on the adaptor connector opposite the opening of the air valve; and wherein the pump adaptor is an air pump adaptor and a plug/cover to seal the opening of the air valve.

* * * * *